US006667671B1

(12) United States Patent
Speldrich et al.

(10) Patent No.: US 6,667,671 B1
(45) Date of Patent: Dec. 23, 2003

(54) WAVEGUIDE SWITCH

(75) Inventors: Werner Speldrich, Backnang (DE); Uwe Rosenberg, Backnang (DE)

(73) Assignee: Tesat-Spacecom GmbH & Co. KG, Backnang (DE)

( * ) Notice: Subject to any disclaimer, the term of this patent is extended or adjusted under 35 U.S.C. 154(b) by 0 days.

(21) Appl. No.: 09/857,393

(22) PCT Filed: Nov. 24, 1999

(86) PCT No.: PCT/DE99/03724

§ 371 (c)(1),
(2), (4) Date: Jun. 5, 2001

(87) PCT Pub. No.: WO00/35041

PCT Pub. Date: Jun. 15, 2000

(30) Foreign Application Priority Data

Dec. 7, 1998 (DE) ..... 198 56 334

(51) Int. Cl.[7] ..... H01P 1/10
(52) U.S. Cl. ..... 333/106; 333/108
(58) Field of Search ..... 333/105, 106, 333/108, 259

(56) References Cited

U.S. PATENT DOCUMENTS 2,898,562 A 8/1959 Trevor ..... 333/259
3,644,852 A * 2/1972 Albee ..... 333/259
4,908,589 A * 3/1990 Basil et al. ..... 333/106
4,967,170 A * 10/1990 Hettlage et al. ..... 333/106
6,218,912 B1 * 4/2001 Mayer ..... 333/106

FOREIGN PATENT DOCUMENTS

DE 40 34 683 5/1992 ..... H01P/1/10
GB 692 308 6/1953
GB 2250140 A * 10/1991 ..... H01P/1/12

* cited by examiner

*Primary Examiner*—Robert Pascal
*Assistant Examiner*—Dean Takaoka
(74) *Attorney, Agent, or Firm*—Kenyon & Kenyon

(57) ABSTRACT

A waveguide switch having a stator and an electrically conducting movable element, the stator having waveguide paths between waveguide terminal pairs, each path being switchable to conducting or nonconducting with the help of the movable element for high-frequency waves. To permit lower requirements regarding manufacturing tolerances, the movable element is designed as a septum in a gap in the stator and extends in the waveguide path, which is switched to nonconducting, in parallel to its E plane. This divides the waveguide path into two partial waveguides, which run in parallel with one another and, in comparison with the switched-to-conducting state of the waveguide path, have smaller cut-off wavelengths.

7 Claims, 3 Drawing Sheets

WAVEGUIDE SWITCH

BACKGROUND INFORMATION

German Patent No. 4 034 683 describes a waveguide switch having a stator with four waveguide terminal pairs and a rotor in which the waveguide paths are present, joining at least two waveguide terminal pairs. The signal paths are switched by the rotation of the rotor (thus also rotation of the waveguide paths in the rotor).

To achieve acceptable electric function (matching, isolation), a high precision is necessary in manufacture of the stator and rotor, and for the combination of these parts in particular, only a very narrow gap is allowed between the stator and rotor, so that a very complicated precision bearing is usually necessary.

SUMMARY OF THE INVENTION

The waveguide switch according to the present invention is composed of two partial shells, each having the halves of the waveguide structure, in particular symmetrically, preferably produced by the milling technique. The corresponding "switch path" is set by a simple, electrically conducting septum, for example, by rotation or displacement.

No complex rotor/stator geometry is necessary. Furthermore, other switch configurations are also possible.

A waveguide switch according to the present invention may be composed of parts that need not be produced with an extremely high precision, so that production costs are much lower than with switches according to the related art. In addition, short switching times can be achieved, because the masses to be moved in switching are very small.

DETAILED DESCRIPTION

Parts that are essentially the same in different figures are labeled with the same reference numbers. The present invention is explained in greater detail below on the basis of two different embodiments. These embodiments represent only a fraction of the possibilities that can be achieved according to the principles of the present invention.

Figure 1C:
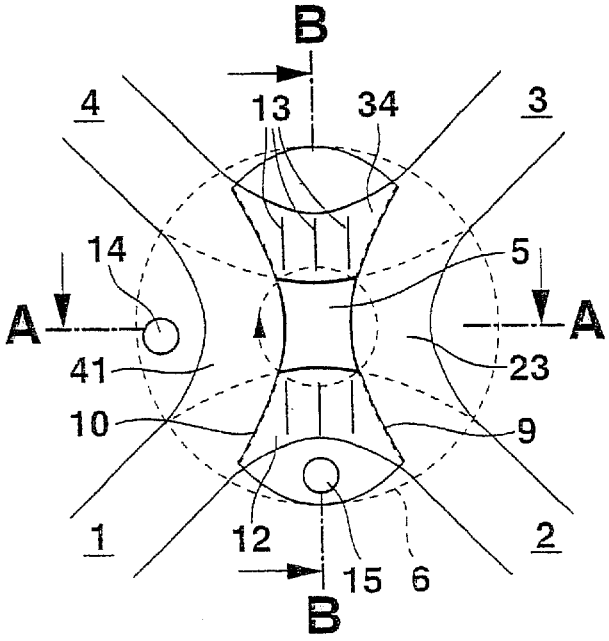
FIGS. 1*a*, 1*b* and 1*c* show the basic design of an embodiment of the waveguide switch according to the present invention in three sectional diagrams.
Figure 1B:
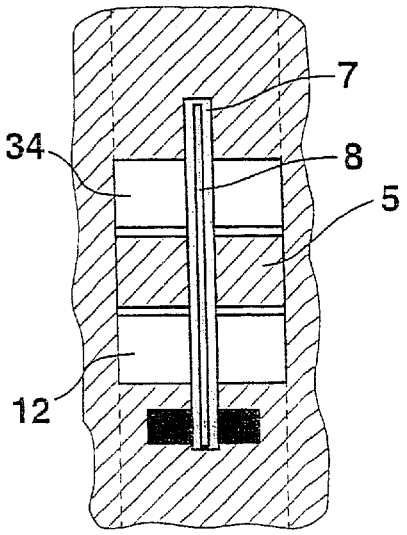
Figure 1A:
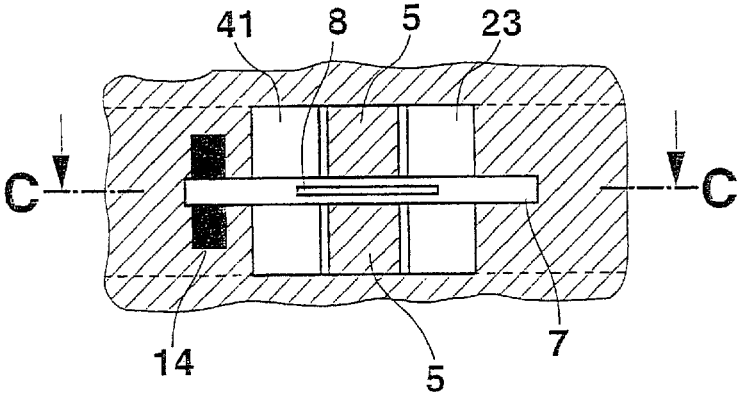

FIGS. 1*a*, 1*b* and 1*c* show three sectional diagrams through a symmetrical switch arrangement, section C—C usually representing the half-shell division of the complete arrangement, i.e., the stator half shell (not including the outer contour) with a movable element (shown here in the form of a rotor). The arrangement has four waveguide terminal pairs 1, 2, 3, 4, where adjacent waveguide terminal pairs are arranged at right angles mutually.

Waveguide paths in the form of 90 degree E plane bends 12, 23, 34, 41 are inserted between adjacent waveguide terminal pairs in the stator in this arrangement, thus forming a branch at each waveguide terminal pair. Due to this arrangement, each stator half-shell has a solid area 5 at the center of the arrangement. In the complete branching area, i.e., within circle 6, a gap 7 is provided between the stator half shells and an electrically conducting septum 8 is provided there. (Gap 7 only has an insignificant influence on the electric properties of the waveguide paths, because it is in the electrically neutral zone of the waveguide paths.) Septum 8 is shaped so that two opposing outer curvature contours 9, 10 almost emulate the contours of the two corresponding E plane bends. In other words, the E plane bends for desired waveguide paths 23, 41are emulated by septum 8. However, the partial areas of the other E plane bends are covered. In these covered areas 12, 34, the waveguide paths are divided by septum 8 into two "partial waveguides" in the middle of their wide sides, so that the cut-off wavelength is much smaller in these areas than the wavelength of the useful frequency band and thus signal propagation is suppressed here.

Figure 2A:
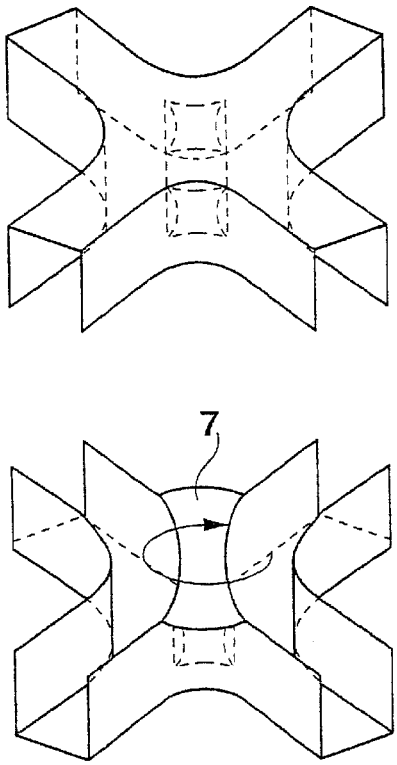
FIGS. 2*a* and 2*b* show an open, three-dimensional diagram (like an exploded diagram) of the waveguide switch according to FIG. 1 for two different switch states.
Figure 2B:
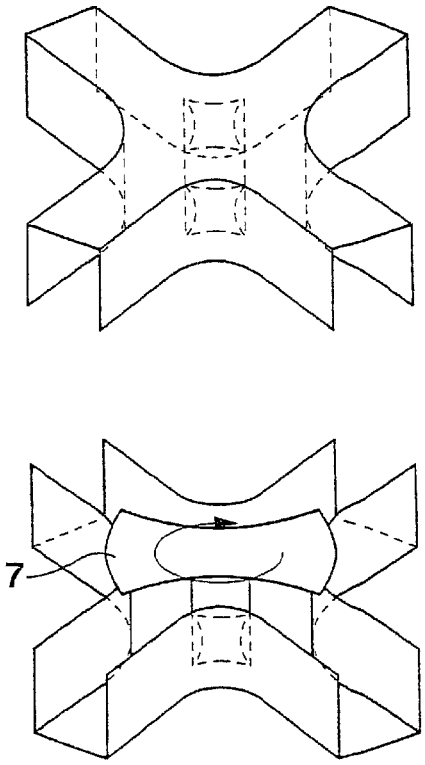

A central rotatable placement of septum 8 in central solid area 5 permits very simple switching of the waveguide paths by rotating septum 8 by 90 degrees (see FIGS. 2*a* and 2*b*).

Septum 8 may be designed with sliding-action contacts, for example, but it is advantageous to arrange the septum in such a way that it is isolated from the waveguide area.

Furthermore, septum 8 may have a frequency-selective structure 13 (for example, elevations, ribs 16*c*, recesses, grooves, holes, slots, material discontinuities) which compensate for disturbances due to the "partial waveguide openings" while also increasing the isolation between the "blocked" waveguide paths.

In addition, septum 8 may also be provided with markings 14, 15, for example, in combination with a photoelectric barrier, for identification of the switch position.

Figure 3A:
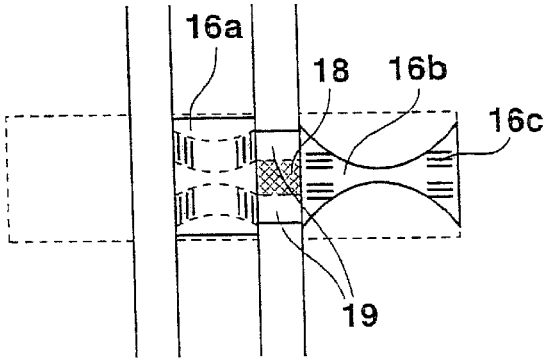
FIGS. 3*a* and 3*b* show additional possible switch configurations.
Figure 3B:
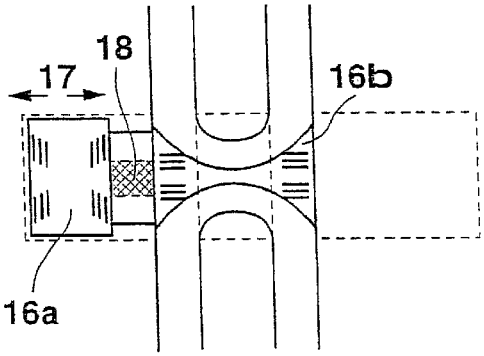

Other switch configurations are also conceivable according to the principle described above. For example, FIGS. 3*a* and 3*b* show an arrangement where the switch function is implemented by displacement of a septum 16. Septum 16 has two separate areas 16*a*, 16*b*, one of which has the configuration of one of the switch positions. To permit displacement of these two areas jointly according to arrows 17, a connecting part 18 which is inserted between areas 16*a*, 16*b* is located in a continuous waveguide path in one switch position (see FIG. 3*a*).

Either this connecting part 18 is designed to be electrically neutral (for example, lambda/4-transformation with transformation stages formed by projections 19 on connecting part 18) or the disturbance caused by the connecting part is compensated in the connecting part itself or in the corresponding waveguide path (through suitable discontinuities 20).

Figure 4A:
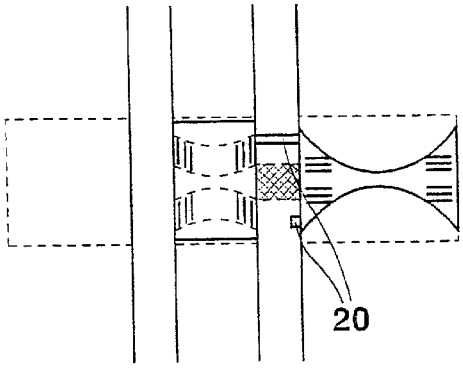
FIGS. 4*a* and 4*b* show further possible switch configurations.
Figure 4B:
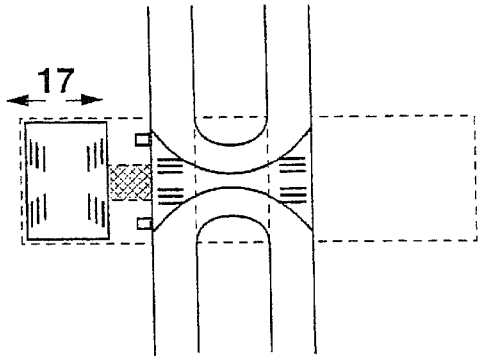

Specifically, the compensation of connecting part 18 may be designed as follows:

a) compensation by having the length of approximately a quarter wavelength, b) connecting part 18 also has one transformer stage 19 for the adjacent waveguide sections, the dielectric being stepped or a dielectric having a different dielectric constant being used; the length of projections 19 on the connecting part which form the transformer stages corresponds to a quarter wavelength;

c) the septum has (additional) discontinuities which are displaced with the septum; for example, in FIG. 4*a*: inductive discontinuity at the top, capacitive discontinuity at the bottom;

d) compensation by (additional) discontinuities/transformations (for example, a change in cross section of the waveguide in the area of connecting part 18) which are in the waveguide and are not displaced with it; this is possible if the discontinuities/transformations are in the parts of the waveguide that are operated together with connecting part 18 only in the conducting operating state.

In a manner similar to the above embodiments, the waveguide switch according to the present invention can be used in a plurality of different configurations, which also have more than four waveguide terminal pairs, for example, and with switching options having highly individual designs.

What is claimed is:

1. A waveguide switch comprising:

waveguide terminal pairs;

an electrically conducting movable element including a septum; and a stator having a gap, the stator further having waveguide paths between the waveguide terminal pairs, the waveguide paths being formed as a contoured non-planar bend, the septum being situated in the gap of the stator and extending in at least one of the waveguide paths, each of the waveguide paths being switchable to conducting or nonconducting via the septum for high-frequency waves, the at least one waveguide path switching to nonconducting, in parallel to an E plane, dividing the waveguide path into two partial waveguides, the two partial waveguides running in parallel with one another and, in comparison with a switched-to-conducting state of the waveguide path, having smaller cut-off wavelengths.

2. The waveguide switch according to claim 1, wherein the septum has a frequency-selective structure which compensates for disturbances due to openings in the partial waveguides and increases an isolation between waveguide paths switched to be nonconducting.

3. The waveguide switch according to claim 1, wherein the septum includes a rotor.

4. The waveguide switch according to claim 1, wherein the septum has a sliding-action.

5. The waveguide switch according to claim 1, further comprising a dielectric connecting part, and wherein the septum has two electrically conducting areas connected by the dielectric connecting part.

6. The waveguide switch according to claim 5, wherein the connecting part includes means for compensating field effects which occur when the connecting part is located in a waveguide path that is switched to be conducting.

7. The waveguide switch according to claim 5, further comprising means, in a waveguide path, for compensating field effects which occur when the connecting part is located in a waveguide path that is switched to be conducting.

* * * * *